US005863637A

United States Patent [19]

Månsson et al.

[11] Patent Number: 5,863,637

[45] Date of Patent: Jan. 26, 1999

[54] MAT AS A SUPPORT FOR PERSONS IN A STANDING WORKING POSTURE

[75] Inventors: Lars H. Månsson; Torben W. Østergaard, both of Odense, Denmark

[73] Assignee: ERGOMAT A/S, Søndersø , Denmark

[21] Appl. No.: 860,353

[22] PCT Filed: Dec. 28, 1995

[86] PCT No.: PCT/DK95/00523

§ 371 Date: Jun. 20, 1997

§ 102(e) Date: Jun. 20, 1997

[87] PCT Pub. No.: WO96/20627

PCT Pub. Date: Jul. 11, 1996

[30] Foreign Application Priority Data

Dec. 29, 1994 [DK] Denmark ..... 1495/94
Apr. 4, 1995 [DK] Denmark ..... 0382/95

[51] Int. Cl.[6] ..... B32B 3/00; A47G 9/06

[52] U.S. Cl. ..... 428/156; 428/120; 5/417

[58] Field of Search ..... 428/174, 178, 428/120, 141, 156; 5/417, 420

[56] References Cited

U.S. PATENT DOCUMENTS

| | | | |
|---|---|---|---|
| 2,809,908 | 10/1957 | French | 428/128 |
| 3,356,562 | 12/1967 | Graham et al. | 428/128 |
| 3,876,492 | 4/1975 | Schott | 428/128 |
| 5,331,750 | 7/1994 | Sasaki et al. | 36/28 |

FOREIGN PATENT DOCUMENTS

| | | |
|---|---|---|
| 170603 | 11/1995 | Denmark . |
| 2328431 | 5/1977 | France . |
| 2029363 | 7/1971 | Germany . |
| 104758 | 6/1942 | Sweden . |
| 983445 | 2/1965 | United Kingdom . |

*Primary Examiner*—Donald Loney
*Attorney, Agent, or Firm*—Watson Cole Grindle Watson, PLLC

[57] ABSTRACT

A resilient mat upon which people can walk or stand includes a pattern of punctiformed portions extending upwardly from an upper side of the mat and a pattern of punctiformed portions extending downwardly from an underside of the mat (to contact an underlying support surface), the upwardly- and downwardly-extending portions being offset from one another so that the upwardly-extending, punctiformed portions will move resiliently downwardly in a direction between downwardly-extending punctiformed portions when subjected to downward force from the foot of a person thereon.

11 Claims, 3 Drawing Sheets

MAT AS A SUPPORT FOR PERSONS IN A STANDING WORKING POSTURE

BACKGROUND OF THE INVENTION

1. Field of the Invention

The invention concerns a mat for supporting persons in a standing working posture that is formed as a carrier layer having a pattern of upwardly-extending portions on an upper side and a pattern of downwardly-extending portions on an underside (by means of which the mat rests on an underlying support), the two patterns being mutually offset.

2. The Prior Art

Elastically resilient mats for supporting persons in a standing working posture to counteract fatigue and injuries to legs and spine are known. A mat of the above type is described in the Danish Patent Application No. 348/93, wherein the two patterns are formed by continuous ribs on the upper side and underside of the mat. The ribs on the upper side are arranged in the spaces between the ribs on the underside and are narrower than the spaces, whereby tension is generated in the free carrier layer section on each side of the ribs when stepping on these.

SUMMARY OF THE INVENTION

The invention provides a mat of this type but wherein it has a punctiformed pattern on the upper side and the underside. This configuration of the mat has been found to give a better standing comfort, as it yields re-siliently in the punctiformed areas and not in line-shaped areas determined by a rib pattern, i.e., the mat can better adapt to the foot pressure thereon. The properties are moreover uniform irrespective of the direction in which the feet are oriented on the mat, while this is not the case with a rib pattern where the properties are noticeably different in the longitudinal direction of the ribs than in the transverse direction. It is noted that a minor overlap of the portions on the upper side and the underside, particularly where the portions are formed with inclined sides, has been found to have no noticeable influence on the comfort properties of the mat. The flatter the sides on the portions are, the more these can overlap each other, as the thickness in the area of overlap is not increased considerably.

Further, the mat has better drain properties because of the punctiformed supporting portions and may be placed arbitrarily with respect to a given liquid flow on the floor, whereas a rib pattern has to be oriented in the direction of flow to allow the water to run inwardly below the mat. Owing to accumulation of dirt and growth sites for bacteria, fungi and microorganisms in general, it is decisive that the contact with the floor be minimized. Apart from the fact that the mat per se must be easy to clean, the punctiformed supporting portions also facilitate cleaning of the floor below it.

The geometry of the punctiformed portions may vary widely and does not have to be the same on the upper side and the underside. Examples of geometrical shapes include squares, trapeziums, triangles, spherical segments, polygons and cones, just to mention a few.

Portions on the underside of the mat terminating in a tip have been found to possess a not quite satisfactory antiskid property in certain situations. Therefore, portions having a certain longitudinal extent are selected to improve the antiskid property, and the portions are angled mutually, optionally grouped, to provide a uniform antiskid property in all directions. If just the longitudinal extent of the portions is not too great, the comfort of the mat will not be affected noticeably.

BRIEF DESCRIPTION OF THE DRAWINGS

Embodiments of the invention will be described more fully below with reference to the accompanying drawings, in which.

DETAILED DESCRIPTION OF THE PREFERRED EMBODIMENT

Figure 1:
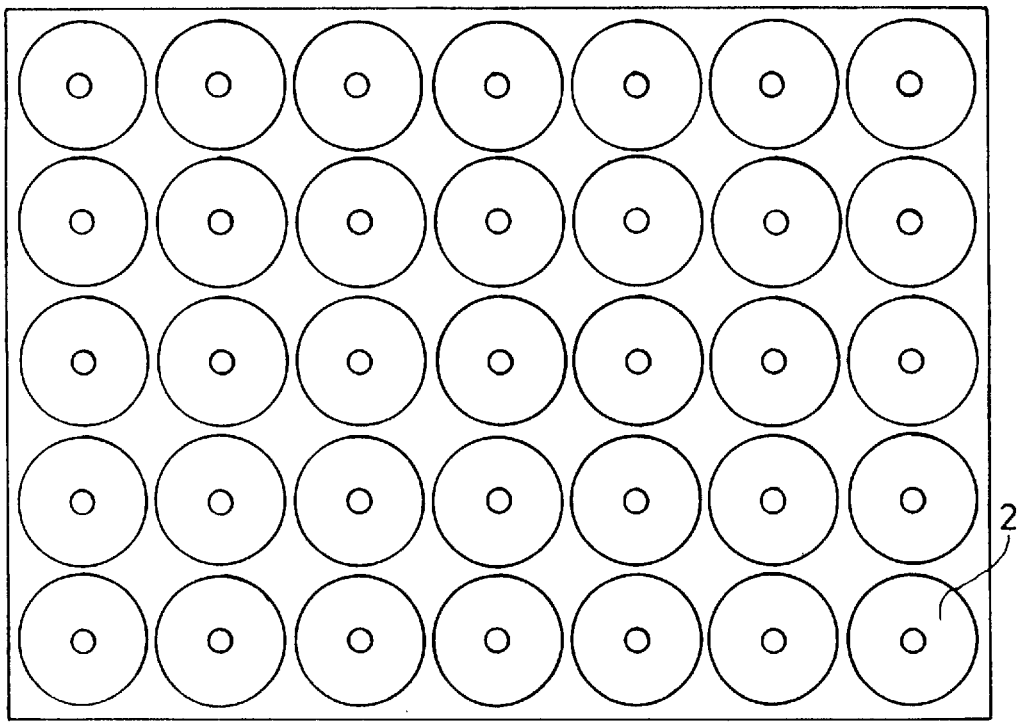
FIG. 1 shows a portion of a mat in accordance with one embodiment of the invention as seen directly from above.
Figure 2:
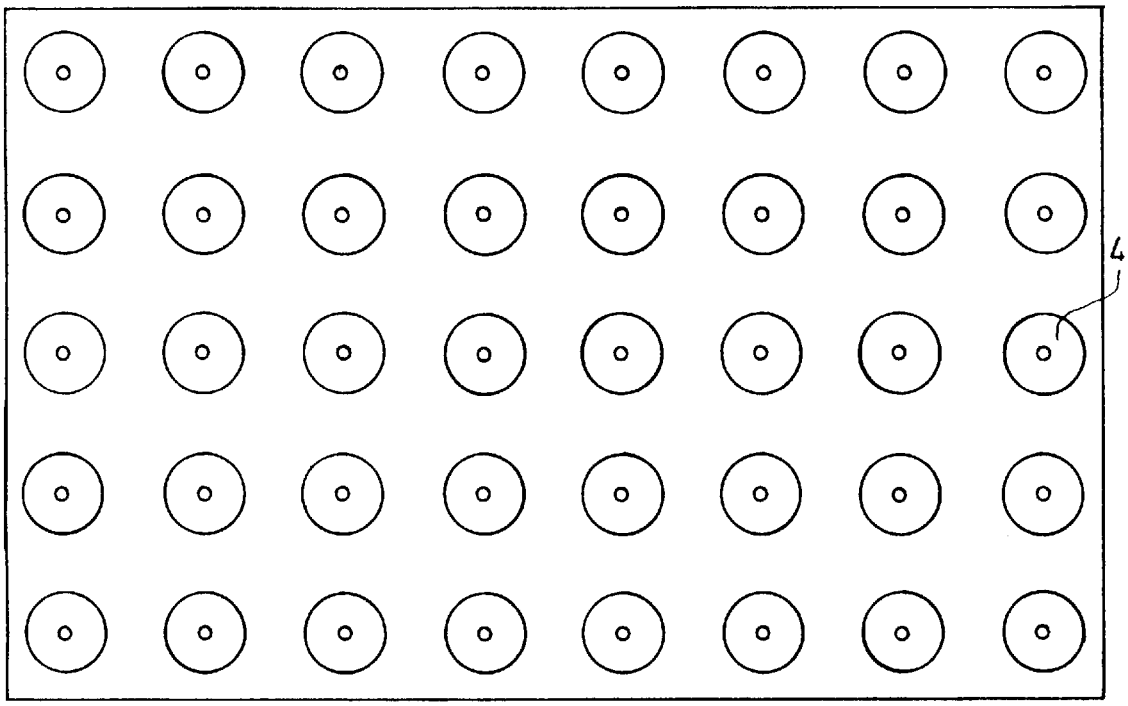
FIG. 2 shows bottom view of FIG. 1.
Figure 4:
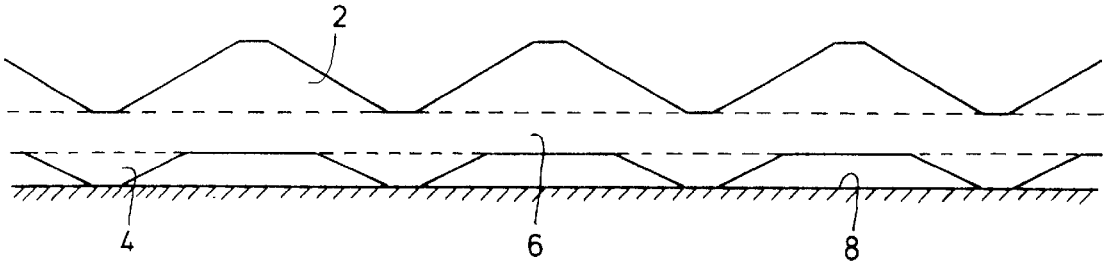
FIG. 4 shows a side view of the mat.

FIG. 1 shows a full scale top view portion of a mat according to a first embodiment of the invention. Its upper side has a pattern of closely spaced cones 2, or rather truncated cones as the outer tip is absent. Between these cones 2 the mat has a pattern on the underside consisting of a another set of more widely spaced cones, as shown in full scale in FIG. 2. The shapes of the cones are identical, but the cones on the underside of the mat are not as high as on the upper side. The dimensions appear from FIG. 4 of the drawing, which shows an enlarged section of the mat seen directly from the side, and in which the carrier layer is designated 6.

Figure 3:
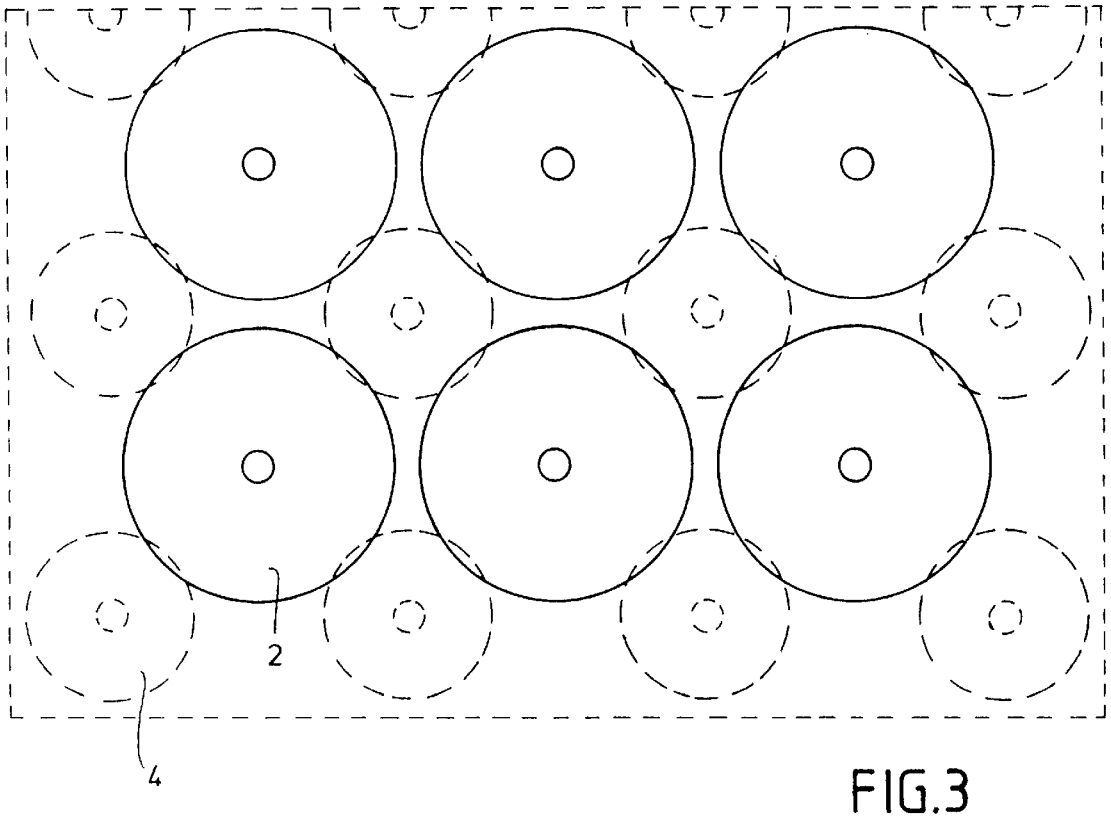
FIG. 3 shows an enlarged section of the mat pattern on the upper side and on the underside, the pattern on the underside being shown in dashed line.

FIG. 3 shows an enlarged section of the mat seen directly from above, where the cones on the underside of the mat are shown in dashed line. As appears from the figure, each cone 2 on the upper side of the mat is supported by four cones 4 on the underside thereof. As shown, the cones on the underside of the mat are tangent to the cones on the upperside figuratively speaking, as they are separated by the carrier layer 6. Thus, there are no direct supports below the tread cones 2 on the upperside of the mat, i.e., they float between the supporting cones 4 on the underside of the mat. A foot pressure on the tread cones 2 will press these elastically down between the supporting cones 4, thereby creating elastic tensile stresses in the carrier layer 6. The point-shaped pattern ensures good adaptation to the footprint on the mat, as the shape of the mat conforms to the print in points. The circumstance that the cones on the underside of the underlying mat rest on the support 8 with their tips also contributes to improving the good elastic properties of the mat. Further, it provides the smallest possible contact face with the floor, thereby reducing growth sites for bacterial fungi and microorganisms in general, and dust entrained by a flow of water below the mat does not easily stick to the downwardly-directed cones. Also, the cone pattern ensures a substantially free flow below the mat.

At locations where the floor is slippery and perhaps also wet, it may be difficult to obtain a sufficient resistance to skidding. The friction may be increased by making the surface of the supporting cones larger.

Figure 5:
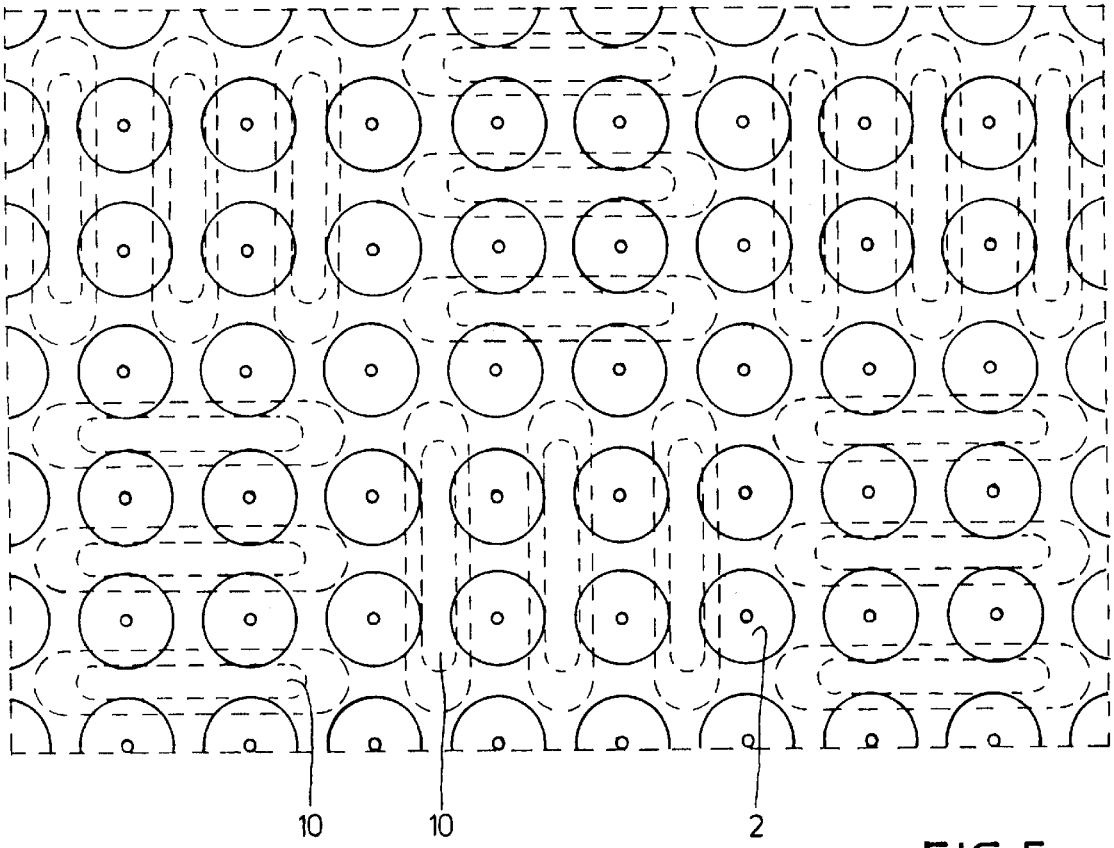
FIG. 5 is a view similar to FIG. 3, of a mat according to another embodiment of the invention.
Figure 6:
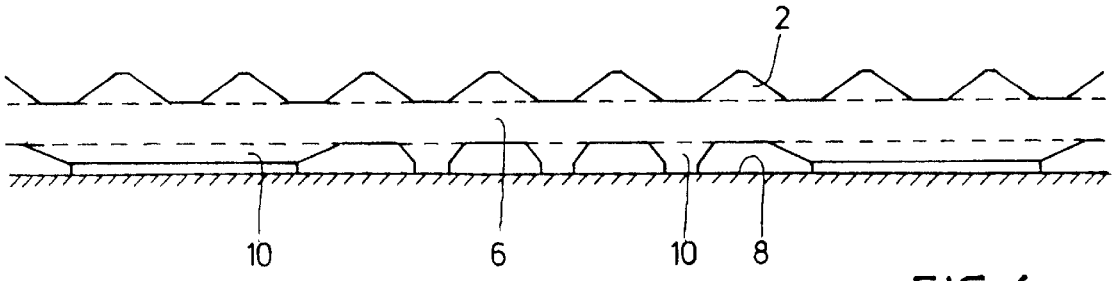
FIG. 6 shows a portion of the mat shown in FIG. 5.

FIGS. 5 and 6 show a pattern on the mat underside having elongate portions 10, which provide an improved antiskid property. The portions are arranged in groups of three, said groups being perpendicular to each other. The upper side of the mat may have a truncated cone pattern 2 like before, there being three truncated cones 2 between two parallel portions 10. Irrespective of the direction, the truncated cones 2 will be perceived as being provided between the elongate portions 10, whose height correspond to the height of the truncated cones 2. The transition between the portions 10 and the intermediate layer 6 is rounded to avoid notch effects. The total width of the portions almost corresponds to the base diameter of the truncated cones.

It will be appreciated that the upper side may be formed with a corresponding pattern of elongate portions, and that a combination of elongate and truly dot-shaped portions may be provided on both the underside and the upper side. In the pattern, the elongate portions may just as well be arranged at an inclined angle, e.g., 45° with respect to each other. The invention thus provides a mat having an excellent comfort for standing persons, the mat lending itself extremely well for use in the food processing industry and the drug industry where the hygiene requirements are very strict, but, of course, the mat may also be used elsewhere.

We claim:

1. A mat for supporting persons in a standing working posture, said mat comprising a resilient carrier layer having a first pattern of upwardly-extending portions on an upper side and a second pattern of downwardly-extending portions on an underside, said downwardly-extending portions contacting an underlying support surface, said first and second patterns being mutually offset and the portions being punctiformed, said punctiformed upwardly-extending portions on said upper side of said mat resiliently moving downwardly in a direction between corresponding punctiformed downwardly-extending portions on said underside of said mat upon the downward force of a foot on said upwardly-extending portions.

2. A mat according to claim 1, wherein the punctiformed portions touch or substantially touch each other in a common plane.

3. A mat according to claim 1, wherein the Punctiformed portions are conical or frustoconical.

4. A mat according to claim 1, wherein the punctiformed portions on the underside of the mat are smaller than the punctiformed portions on the upper side of the mat.

5. A mat according to claim 1, wherein the end face of the punctiformed portions on the underside of the mat is relatively large to provide a great antiskid property.

6. A mat according to claim 1, wherein the punctiformed portions on the underside of the mat are elongated to provide a great antiskid property.

7. A mat according to claim 1, including non-rotationally symmetrical punctiformed portions gathered in groups, said groups being angled with respect to each other to provide a great antiskid property.

8. A mat according to claim 7, wherein the punctiformed portions on the underside of the mat are short ribs gathered in groups of three, said groups being angled 90° with respect to each other.

9. A mat according to claim 8, wherein a length of each short rib corresponds to three punctiformed portions on the upper side of the mat.

10. A mat according to claim 9, wherein the punctiformed portions on the upper side of the mat are conical or frustoconical.

11. A mat according to claim 6, wherein the punctiformed portions on the underside of the mat are short ribs gathered in groups of three, said groups being angled 90° with respect to each other.

* * * * *